US009089957B2

(12) United States Patent
Chen

(10) Patent No.: US 9,089,957 B2
(45) Date of Patent: Jul. 28, 2015

(54) TORQUE WRENCH WITH CONSTANT TORQUE

(71) Applicant: Zhu-Cun Chen, Taichung (TW)

(72) Inventor: Zhu-Cun Chen, Taichung (TW)

( * ) Notice: Subject to any disclaimer, the term of this patent is extended or adjusted under 35 U.S.C. 154(b) by 82 days.

(21) Appl. No.: 14/136,857

(22) Filed: Dec. 20, 2013

(65) Prior Publication Data

US 2015/0174745 A1 Jun. 25, 2015

(51) Int. Cl.

| | |
|---|---|
| ***B25B 23/14*** | (2006.01) |
| ***B25B 13/46*** | (2006.01) |
| ***B25B 23/00*** | (2006.01) |
| ***B25B 23/142*** | (2006.01) |
| *B25B 13/48* | (2006.01) |

(52) U.S. Cl.

CPC ..... *B25B 23/141* (2013.01); *B25B 13/465* (2013.01); *B25B 23/0007* (2013.01); *B25B 23/14* (2013.01); *B25B 23/142* (2013.01); *B25B 23/1427* (2013.01); *B25B 13/48* (2013.01)

(58) Field of Classification Search

CPC .. B25B 23/1427; B25B 23/141; B25B 23/14; B25B 23/142; B25B 13/48

USPC ..... 81/467, 473, 475

See application file for complete search history.

(56) References Cited

U.S. PATENT DOCUMENTS

| | | | | | |
|---|---|---|---|---|---|
| 2,897,704 | A * | 8/1959 | Woods | 81/481 |
| 2,984,133 | A * | 5/1961 | Zimmerman | 81/474 |
| 4,655,104 | A * | 4/1987 | Blattner | 81/483 |
| 4,901,610 | A * | 2/1990 | Larson et al. | 81/473 |
| 5,129,293 | A * | 7/1992 | Larson et al. | 81/483 |
| 5,174,176 | A * | 12/1992 | Krivec | 81/63.1 |
| 5,557,994 | A * | 9/1996 | Nakayama | 81/478 |
| 6,945,144 | B1 * | 9/2005 | Cutler et al. | 81/483 |
| 6,990,877 | B1 * | 1/2006 | Wu | 81/467 |
| 7,270,036 | B1 * | 9/2007 | Chen | 81/467 |
| 7,587,961 | B1 * | 9/2009 | Chiang | 81/62 |
| 8,141,463 | B2 * | 3/2012 | Lai | 81/475 |
| 2002/0040628 | A1 * | 4/2002 | Kemp et al. | 81/467 |

* cited by examiner

*Primary Examiner* — Monica Carter
*Assistant Examiner* — Danny Hong
(74) *Attorney, Agent, or Firm* — Muncy, Geissler, Olds & Lowe, P.C.

(57) ABSTRACT

A torque wrench with constant torque comprises a wrench body having a tube and a cavity, an adapter, a pillar, a clutching member, a handle, and a resilient member. Therein, the adapter is rotatably disposed in the cavity, with plural adapting parts disposed on the outer periphery thereof. The pillar is disposed between the tube and the cavity for resisting against the adapting part. The clutching member is disposed in the tube, with a first end resisting against the peripheral surface of the pillar, a second end and a peripheral edge rollingly contacting the inner edge of the tube. The handle is connected to one end of the tube. The resilient member is disposed inside the tube for resisting against the second end of the clutching member. Thus, the torque is transmitted directly and prevented from diminishing, maintain a precise torque value.

18 Claims, 6 Drawing Sheets

TORQUE WRENCH WITH CONSTANT TORQUE

BACKGROUND OF THE INVENTION

1. Field of the Invention

The present invention relates to torque wrenches, and particularly, to a torque wrench with constant torque, which maintains precise torque value during operation.

2. Description of the Related Art

Known structure of a torque wrench comprises a head for receiving a screw member, a hollowed shaft, a handle, and a clutching member disposed between the handle and the head. Through the adjustment of the handle against the hollowed shaft, the prestressed force of the clutching member upon the head is changed, whereby when the screw member received by the head bears a torque surpassing the prestressed force, the clutching effect is produced to limit the torque bore by the screw member, preventing the screw member from damaged.

However, said clutching member is disposed in the hollowed shaft in a manner of surface-contact, wherein the contacted dimension is relatively large. During the operation of the torque wrench, the prestressed force of the clutching member is dispersed on the contacted surface, whereby the prestressed force is not efficiently transmitted to the screw member received by the head; also, the torque feedback of the screw member is dispersed, causing the inaccuracy of the measured torque value, while the torque value is not maintained constantly. As a result, the screw member might be damaged after repeatedly used.

SUMMARY OF THE INVENTION

For improving foregoing issues, the present invention discloses a torque wrench with constant torque, which utilized an internal structure for decreasing contacted dimension of a clutching member, whereby the torque is transmitted more directly and kept from diminishing, thus maintaining a precise torque value.

The present invention herein provides a torque wrench with constant torque, comprising:

a wrench body, defining a first axis and a second axis in perpendicular to the first axis, with a tube provided along the first axis, and a cavity rotatably provided on the second axis;

an adapter, rotatably disposed along the second axis in the cavity, with plural adapting parts provided on an outer periphery of the adapter;

a pillar, disposed between the tube and the cavity, with a central axis defined by the pillar in parallel to the second axis and a peripheral surface surrounding the central axis for contacting the adapting part;

a clutching member, moveably disposed in the tube and provided with a first end, a second end, and a peripheral edge, wherein the first end contacts the peripheral surface of the pillar, and the peripheral edge rollingly contacts an inner wall of the tube;

a handle, connected to an end of the tube; and a resilient member, disposed inside the tube for resisting against the second end of the clutching member.

Also provided is a torque wrench with a plurality of ball columns equidistantly provided on the peripheral surface of the clutching member.

Also provided is a torque wrench with a circular column embedded in the first end of the clutching member, and a terminal surface of the circular column resisting against the peripheral surface of the pillar.

Also provided is a torque wrench with a first contacting surface and a second contacting surface provided on the adapter, wherein the first and second contacting surfaces are embedded with plural steel balls, respectively, and the cavity is provided with a lid, while the adapter contacts a bottom board of the cavity and an internal surface of the lid in a manner of point-contact.

Also provided is a torque wrench with constant torque, comprising:

a wrench body, defining a first axis and a second axis in perpendicular against the first axis, with a tube provided along the first axis, and a cavity provided on the second axis;

an adapter, rotatably disposed along the second axis in the cavity, with plural adapting parts provided on an outer periphery of the adapter, wherein each adapting part comprises a concave arc and two convex arcs symmetrically formed on both sides of the concave arc, while the adapter is allowed to drive a screw member unidirectionally;

a pillar, disposed between the tube and the cavity, with a central axis defined by the pillar in parallel against the second axis and a peripheral surface provided with the central axis as the center for contacting the concave arc and convex arcs;

a clutching member, moveably disposed in the tube and provided with a first surface and a second surface, wherein the first surface is a plane and contacts the peripheral surface of the pillar in a manner of line-contact;

a handle, connected to an end of the tube; and a resilient member, disposed inside the tube for resisting against the second surface of the clutching member.

Regarding components of the present invention for transmitting the torque, structures with relatively small contacted dimension are utilized for decreasing the dimension contacted, thereby lowering relative friction to facilitate the more direct transmission of the torque without diminishing and dispersing the torque, thus maintaining a precise torque value.

DETAILED DESCRIPTION OF THE INVENTION

Other and further advantages and features of the present invention will be understood by reference to the description of the preferred embodiment in conjunction with the accompanying drawings where the components are illustrated based on a proportion for explanation but not subject to the actual component proportion.

Figure 1:
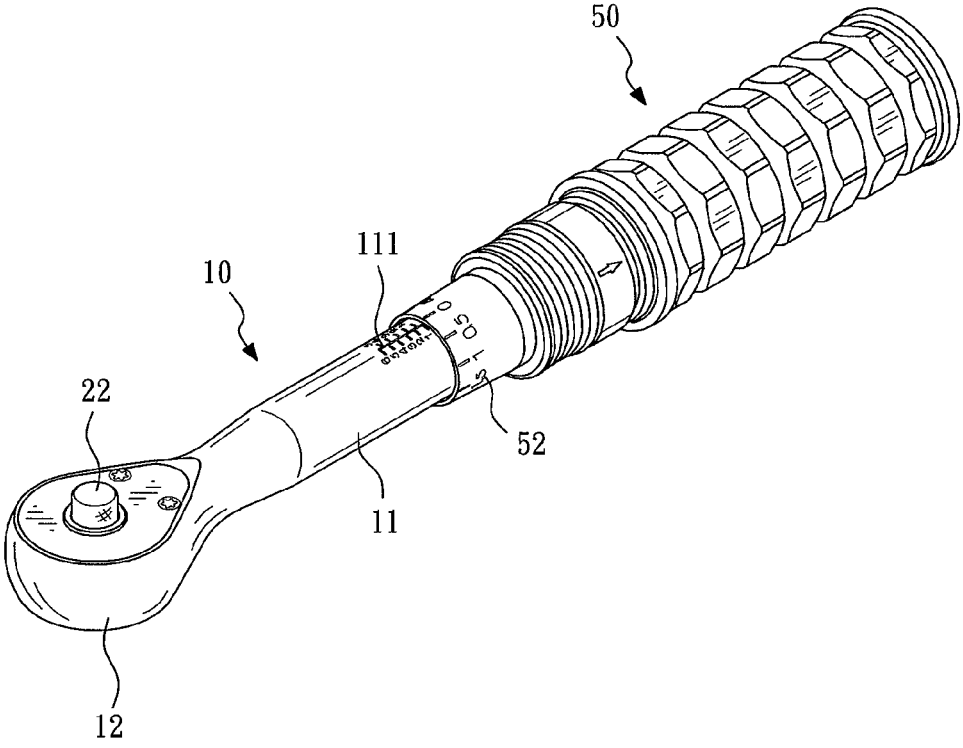
FIG. 1 is a perspective view of the torque wrench in accordance with the present invention.
Figure 2:
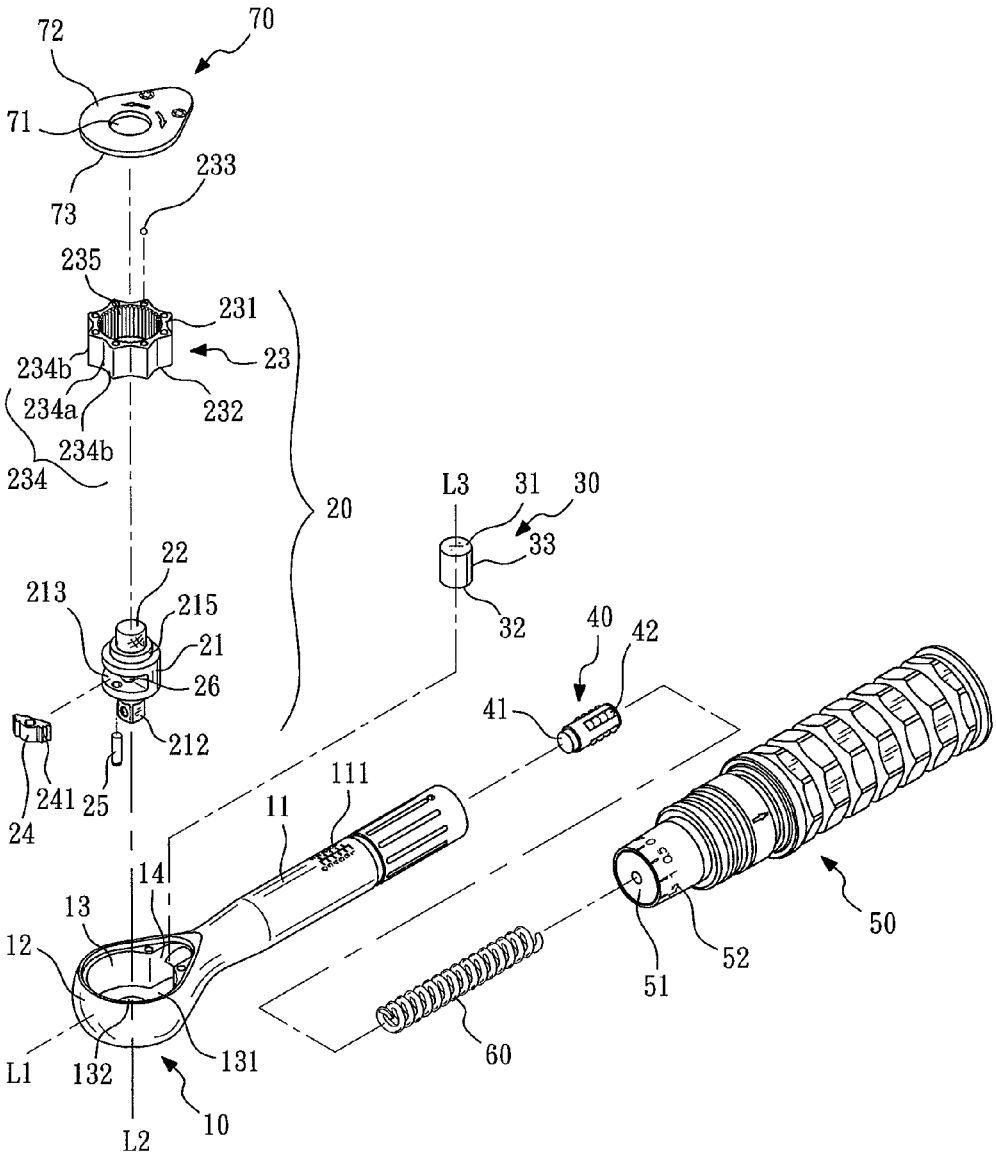
FIG. 2 is the exploded view of the torque wrench in accordance with the present invention.
Figure 3:
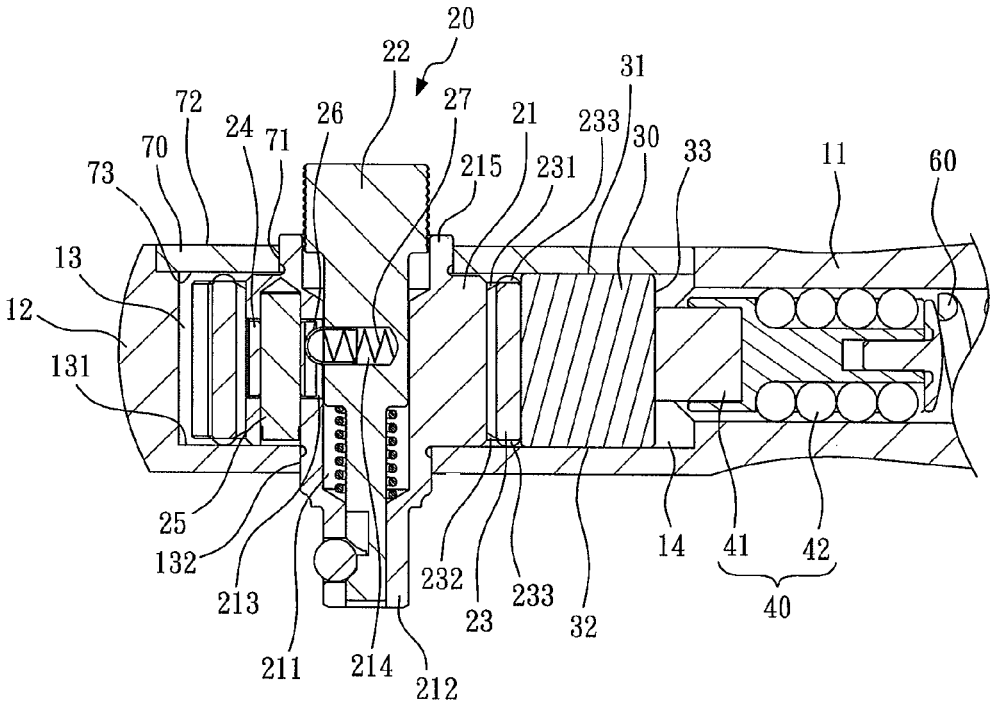
FIG. 3 is the side-sectional view of the torque wrench in accordance with the present invention.

Referring to FIG. 1 to FIG. 3, the torque wrench of the present invention comprises a wrench body 10, an adapter 20, a pillar 30, a clutching member 40, a handle 50, a resilient member 60, and a lid 70.

The wrench body 10 defines a first axis L1 and a second axis L2 which is perpendicular to the first axis L1, and a tube 11 is provided along the first axis L1, while a head 12 is provided on one end of the tube 11. A cavity 13 is provided on the head 12 along the second axis L2, with a torque value scale 111 settled on the outer periphery of the tube 11, while a recess 14 is provided on a lateral side of the cavity 13 and connected with the tube 11. The cavity 13 is provided with a bottom board 131 which is as well the bottom plane of the recess 14, wherein a difference of elevation exists between the bottom board 131 and the tube 11. Also, the bottom board 131 is provided with a through hole 132.

The adapter 20 is rotatably disposed in the cavity 13 and capable of driving a tool head such as a sleeve for further driving a screw member. The adapter 20 comprises an adapting member 21, a rod 22, a ring 23, and a toothed block 24. Therein, the adapting member 21 is provided with an axis hole 211 inserted by the rod 22, and a mounting part 212 is provided on one end of the adapting member 21 to pass and expose outward from the through hole 132. Further, an arc recess 213 is provided openly on the lateral side of the adapting member 21 and transversely connected with the through hole 214 of the rod 22.

Further, another end of the adapting member 21 is provided with a protrusive ring 215. The rod 22 is resiliently disposed in the axis hole 211 and capable of axially moving against the adapting member 21 for enabling the mounting part 212 to optionally brake or release the sleeve. The ring 23 is provided with a first contacting surface 231 and a second contacting surface 232 on the top side and bottom side thereof, while the first and second contacting surfaces 231, 232 are embedded with plural steel balls 233, respectively, wherein the steel balls 233 of the second contacting surface 232 contacts the bottom board 131 in a manner of point-contact. In addition, the ring 23 mounts around the adapting member 21 with a plurality of adapting parts 234 disposed on the periphery thereof. Each adapting part 234 comprises a concave arc 234*a* and two convex arcs 234*b* symmetrically formed on both sides of the concave arc 234*a*. The inner edge of the ring 23 is provided with a toothed portion 235. A toothed block 24 is pivotally disposed in the arc recess 213 and sandwiched by the ring 23 and the rod 22 by a pin 25, while two lateral sides of the toothed block 24 are provided with teeth 241, respectively. Therein, the peripheral edge of the rod 22 contacting the toothed block 24 is provided with a resisting member 26 and a spring 27, with the resisting member 26 exposing from the through hole 214 for resisting against the toothed block 24, whereby the toothed block 24 is allowed to optionally laterally gear the toothed portion 235. Additionally, the head portion of the rod 22 is allowed to be provided with an embossment or other patterns with equivalent effect for facilitating the driving.

The pillar 30 is disposed in the recess 14 between the tube 11 and the cavity 13 and provided with an upper surface 31 and a lower surface 32, with a central axis L3 in parallel to the second axis L2 and passing through the central point of the upper and lower surfaces 31, 32. Further, a peripheral surface 33 is disposed around the central axis L3 between the upper and lower surfaces 31, 32 for contacting the concave arc 234*a* and convex arcs 234*b* of the adapting part 234.

Figure 4:
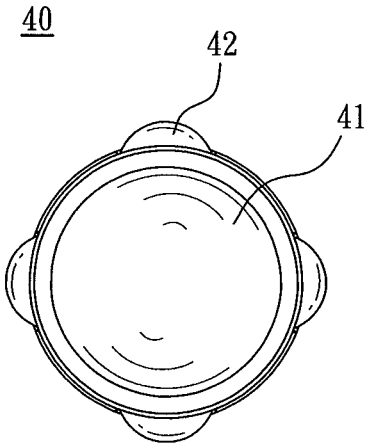
FIG. 4 is an end view of the clutching member of the torque wrench in accordance with the present invention.

The clutching member 40 is moveably disposed in the tube 11 with a circular column 41 embedded on one end thereof, wherein a terminal surface of said end is a plane for resisting against the peripheral surface 33 of the pillar 30. Furthermore, a plurality of ball columns 42 are equidistantly provided on the peripheral surface of the clutching member 40, wherein each angle included intermediately by two ball columns 42 is 60 degree, while each ball column 42 is formed of four balls axially disposed. As shown in FIG. 4, each ball slightly protrudes from the peripheral edge of the clutching member 40, whereby the clutching member 40 rollingly contacts the inner wall of the tube 11.

The handle 50 is hollowed and rotatably connected to one end of the tube 11, wherein an adjusting assembly 51 is disposed in the handle 50 and allowed to axially move due to the rotation of the handle 50 for resisting and pushing the resilient member 60, which can be a spring and is also disposed inside the tube 11, toward the clutching member 40. Therein, an indicating scale 52 is provided on the handle 50 for corresponding to a torque value scale 111 provided on the tube 11, thereby indicating a correct torque value.

The lid 70 is installed onto the openings of both the cavity 13 and the recess 14 with a through hole 71 disposed thereon for an end of the adapter 20, particularly the protrusive ring 215 and a head portion of the rod 22 as well, to pass through and expose outward. Further, the lid 70 is provided with an external surface 72 and an internal surface 73, while the internal surface 73 is contacted by the steel balls 233 of the first contacting surface 231 of the ring 23 in a manner of point-contact.

Figure 5:
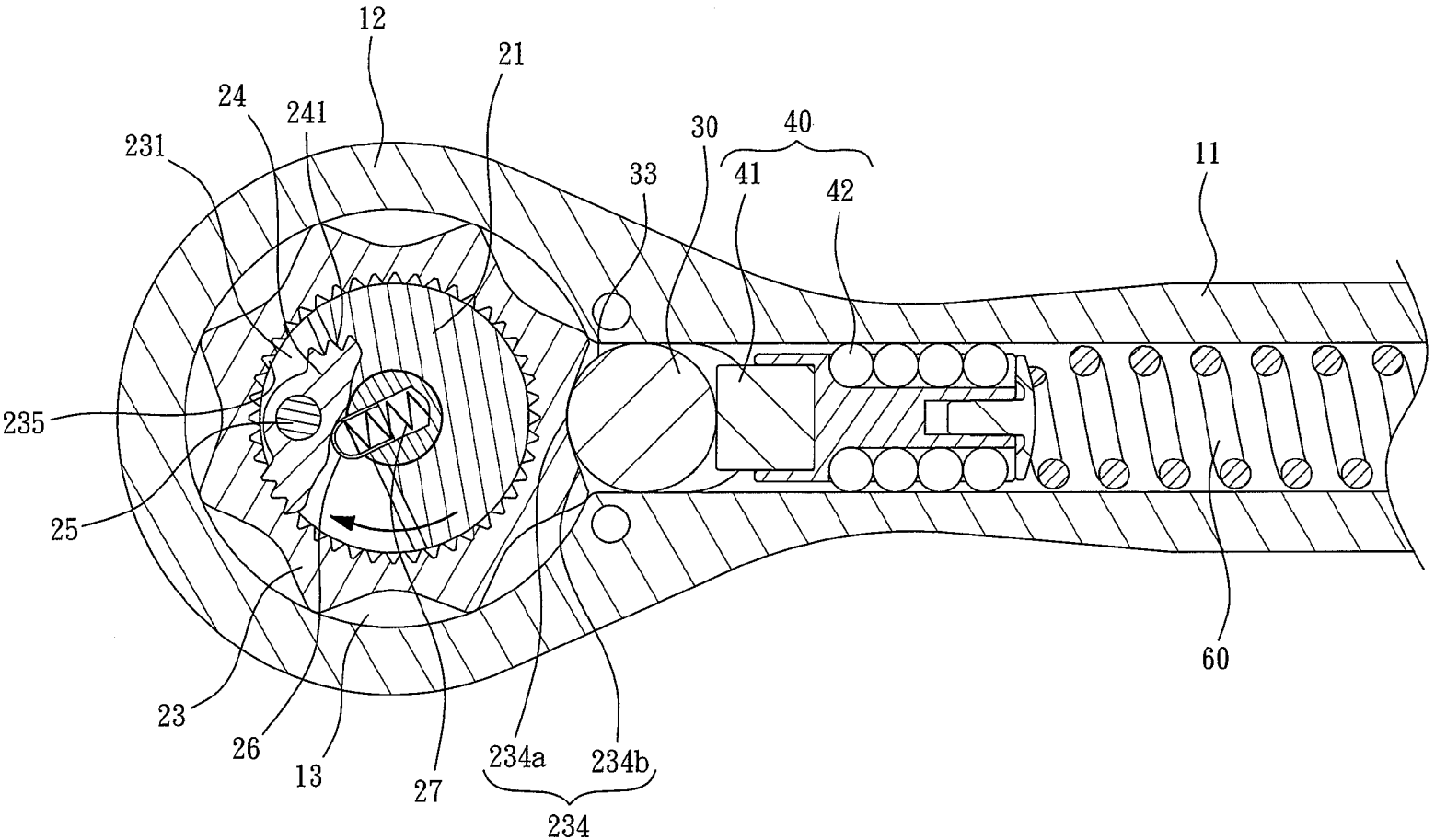
FIG. 5 is a schematic view illustrating an operation status of the present invention.
Figure 6:
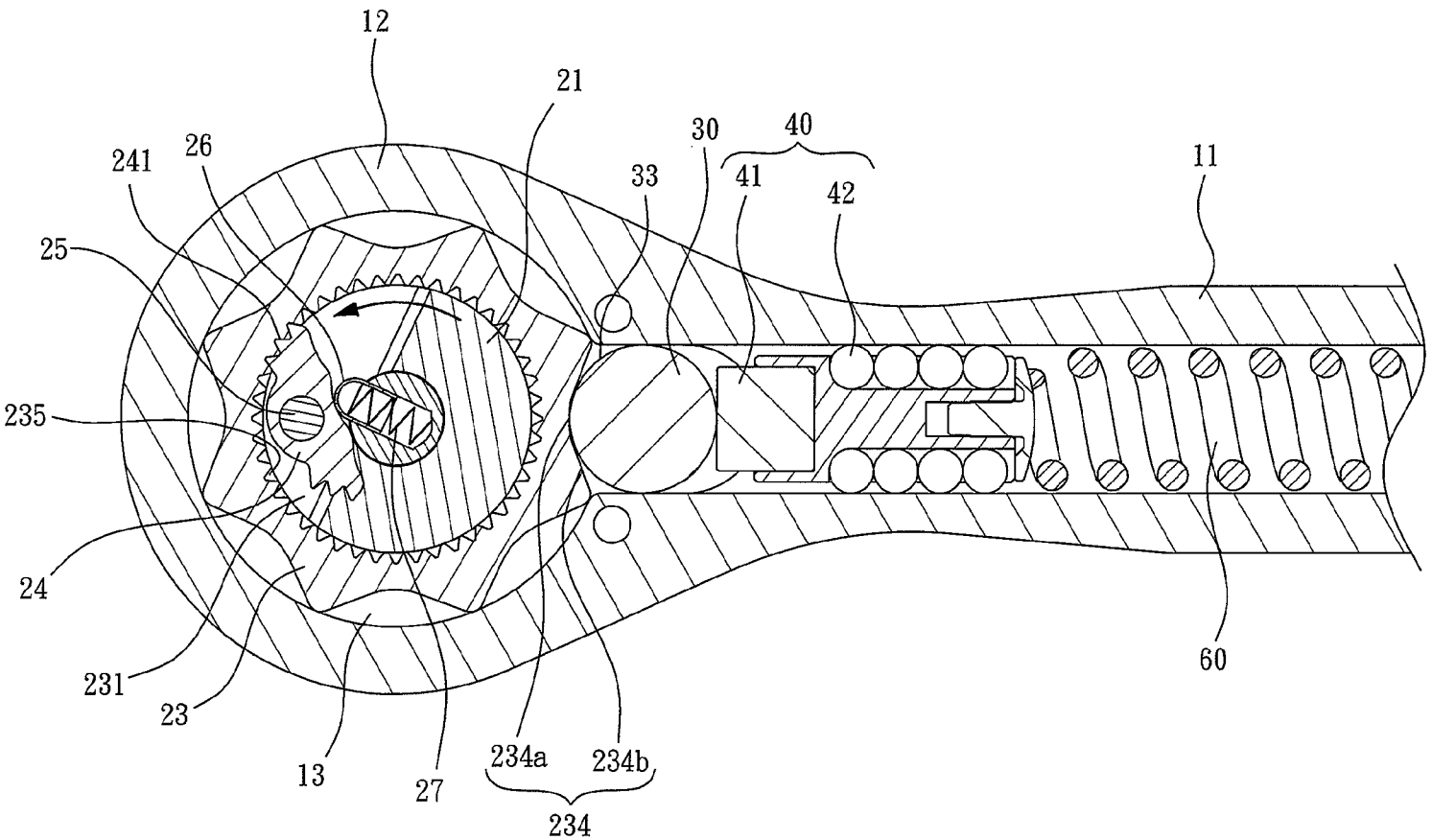
FIG. 6 is another schematic view illustrating an operation status of the present invention.

Referring to FIG. 3, FIG. 5 and FIG. 6, when the resilient member 60 resists against the clutching member 40 with a certain prestressed force, the clutching member 40 thus resists and pushes the pillar 30 toward one of the adapting part 234 of the ring 23, whereby the peripheral surface 33 of the pillar 30 contacts the concave arc 234*a* and the convex arcs 234*b*. When a predetermined torque value is reached, the peripheral surface 33 of the pillar 30 gradually leans toward one of the two convex arcs 234*b* due to the rotation of the ring 23, and further jumps across the present adapting part 234 to resist against another adapting part 234. In another word, when the predetermined torque value is reached, a tripping effect is thus occurred for preventing the screw member from being damaged. Therein, during the operation, the clutching member 40 contacts the inner edge of the tube 11 in a manner of rolling-contact and the pillar 30 contacts the clutching member 40 in a manner of line-contact, whereby the torque is prevented from dispersing due to a relatively small contacted dimension when the torque is transmitted. As a result, a precise torque value is maintained. Furthermore, during the rotation of the ring 23, the steel balls 233 of both the first and second contacting surfaces 231, 232 contacts the internal surface 73 of the lid 70 and the bottom board 131 in a manner of point-contact, respectively, so the contacted dimension and relative friction are decreased, whereby the torque is transmitted more directly and prevented from diminishing, thus maintaining a precise torque value.

More, by rotating the rod 22, the resisting member 26 brakes the toothed block 24 toward either left or right side, and drives the ring 23 to unidirectionally rotate. Therefore, the torque wrench of the present invention possesses the bidirectional braking function of ordinary ratchet wrenches, and facilitates an easy operation when efficiently detaching screw members is needed.

To sum up, the torque wrench provided by the present invention applies structures with relatively smaller contacted dimension. For decreasing the contacted dimension and the relative friction, the clutching member contacts the inner edge of the tube in a manner of rolling-contact, the pillar contacts the clutching member in a manner of line-contact, and the ring contacts the lid and the cavity in a manner of point-contact, whereby the torque is transmitted more directly and prevented from dispersing and diminishing, thus maintaining a precise torque value.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A torque wrench with constant torque, comprising:

a wrench body, defining a first axis and a second axis in perpendicular to the first axis with a tube provided along the first axis, and a cavity provided on the second axis;

an adapter, rotatably disposed along the second axis in the cavity, with plural adapting parts provided on an outer periphery of the adapter;

a pillar, disposed between the tube and the cavity, with a central axis defined by the pillar in parallel to the second axis and a peripheral surface provided with the central axis as the center for contacting the adapter;

a clutching member, moveably disposed in the tube and provided with a first end, a second end, and a peripheral edge, wherein the first end contacts the peripheral surface of the pillar, and the peripheral edge rollingly contacts an inner edge of the tube;

a handle, connected to an end of the tube; and a resilient member, disposed inside the tube for resisting against the second end of the clutching member.

2. The torque wrench of claim 1, wherein a plurality of ball columns are equidistantly provided on the peripheral edge of the clutching member.

3. The torque wrench of claim 1, wherein a circular column is embedded on the first end of the clutching member, while a terminal surface of the circular column resists against the peripheral surface of the pillar.

4. The torque wrench of claim 1, wherein the handle is hollowed and rotatably connected to one end of the tube, and an adjusting assembly is disposed in the handle and allowed to axially move due to the rotation of the handle for resisting and pushing the resilient member toward the second end of the clutching member.

5. The torque wrench of claim 1, wherein the adapter comprises:

an adapting member, with one end thereof provided with a mounting part protruding and exposing outward from the cavity;

a rod, inserted through the adapting member, capable of axially and rotatably moving against the adapting member, and causes the mounting part to optionally brake or release a sleeve in axial movement;

a ring, mounting around the adapting member, the adapting part disposed on a peripheral edge of the ring, and a toothed portion disposed on an inner edge of the ring; and a toothed block, pivotally disposed and sandwiched by the rod and the ring, while the toothed block laterally gears the toothed portion due to the rotating movement of the rod for unidirectionally rotating the sleeve.

6. The torque wrench of claim 5, wherein an arc recess is provided on a lateral side of the adapting member for pivotally receiving the toothed block, and the rod is provided with a resisting member and a spring for resisting and pushing the toothed block toward the toothed portion.

7. A torque wrench with constant torque, comprising:

a wrench body, defining a first axis and a second axis in perpendicular against the first axis, with a tube provided along the first axis, and a cavity provided on the second axis;

an adapter, rotatably disposed along the second axis in the cavity, with plural adapting parts provided on an outer periphery of the adapter, wherein each adapting part comprises a concave arc and two convex arcs symmetrically formed on both sides of the concave arc, while the adapter is allowed to drive a screw member unidirectionally;

a pillar, disposed between the tube and the cavity, with a central axis defined by the pillar in parallel against the second axis and a peripheral surface provided with the central axis as the center for contacting the concave arc and convex arcs;

a clutching member, moveably disposed in the tube and provided with a first surface and a second surface, wherein the first surface is a plane and contacts the peripheral surface of the pillar in a manner of line-contact;

a handle, connected to an end of the tube; and a resilient member, disposed inside the tube for resisting against the second surface of the clutching member.

8. The torque wrench of claim 7, wherein the clutching member contacts an inner edge of the tube in a manner of rolling-contact.

9. The torque wrench of claim 7, wherein the handle is hollowed and rotatably connected to one end of the tube, and an adjusting assembly is disposed in the handle and allowed to axially move due to the rotation of the handle for resisting and pushing a resilient member toward the second surface of the clutching member.

10. The torque wrench of claim 7, wherein the adapter comprises:

an adapting member, with one end thereof provided with a mounting part protruding and exposing outward from the cavity;

a rod, inserted through the adapting member, capable of axially and rotatably moving against the adapting member, and causes the mounting part to optionally brake or release a sleeve in axial movement;

a ring, mounting around the adapting member, the adapting parts disposed on the periphery edge of the ring, and a toothed portion disposed on an inner edge of the ring; and a toothed block, pivotally disposed and sandwiched by the rod and the ring, while the toothed block laterally gears the toothed portion due to the rotating movement of the rod for unidirectionally rotating the sleeve.

11. The torque wrench of claim 10, wherein an arc recess is provided on a lateral side of the adapting member for pivotally receiving the toothed block, and the rod is provided with a resisting member and a spring for resisting and pushing the toothed block toward the toothed portion.

12. A torque wrench with constant torque, comprising:

a wrench body with a tube and a head extending from the tube, wherein the head is provided with a cavity and a recess interconnecting the cavity and the tube, and the cavity is provided with a bottom board, while a through hole is provided on the bottom board;

an adapter, rotatably disposed in the cavity and provided with a first end, a second end, a first contacting surface, and a second contacting surface, wherein the first and second contacting surfaces are embedded with plural steel balls, respectively, and the adapter contacts the bottom board of the cavity with the first end protruding and exposing from the through hole for receiving a sleeve, while plural adapting parts provided on an outer periphery of the adapter;

a pillar, disposed in the recess for resisting against the adapting part of the adapter;

a clutching member, moveably disposed in the tube and provided with a first surface and a second surface, while the first surface is a plane and resisting against an outer periphery of the pillar;

a lid, installed onto openings of both the cavity and the recess with a through hole disposed thereon for the second end of the adapter to pass through and expose outward, while the lid is provided with an external surface and an internal surface contacted by the steel balls of the adapter in a manner of point-contact;

a handle, connected to an end of the tube; and a resilient member, disposed inside the tube for resisting against the second surface of the clutching member.

13. The torque wrench of claim 12, wherein the clutching member contacts an inner edge of the tube in a manner of rolling-contact.

14. The torque wrench of claim 12, wherein the cavity is provided with a bottom board which is the same plane with the bottom plane of the recess.

15. The torque wrench of claim 12, wherein the pillar is provided with an upper surface contacting the internal surface of the lid, and a lower surface resisting against the bottom board.

16. The torque wrench of claim 12, wherein the handle is hollowed and rotatably connected to one end of the tube, and an adjusting assembly is disposed in the handle and allowed to axially move due to the rotation of the handle for resisting and pushing the resilient member toward the second surface of the clutching member.

17. The torque wrench of claim 12, wherein the adapter comprises:

an adapting member, with one end thereof provided with a mounting part protruding and exposing outward from the through hole;

a rod, inserted through the adapting member, capable of axially and rotatably moving against the adapting member, and causes the mounting part to optionally brake or release the sleeve in axial movement;

a ring, mounting around the adapting member, the adapting parts disposed on the periphery edge of the ring, the first contacting surface and the second contacting surface disposed on both top and bottom ends of the ring, respectively, and a toothed portion disposed on an inner edge of the ring; and a toothed block, pivotally disposed and sandwiched by the rod and the ring, while the toothed block laterally gears the toothed portion due to the rotating movement of the rod for unidirectionally rotating the sleeve.

18. The torque wrench of claim 17, wherein an arc recess is provided on a lateral side of the adapting member for pivotally receiving the toothed block, and the rod is provided with a resisting member and a spring for resisting and pushing the toothed block toward the toothed portion.

* * * * *